US010746396B2

(12) United States Patent
Cadima

(10) Patent No.: US 10,746,396 B2
(45) Date of Patent: Aug. 18, 2020

(54) GAS BURNER FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 205 days.

(21) Appl. No.: 15/790,103

(22) Filed: Oct. 23, 2017

(65) Prior Publication Data

US 2019/0120486 A1 Apr. 25, 2019

(51) Int. Cl.
*F23D 14/08* (2006.01)
*F24C 3/08* (2006.01)

(52) U.S. Cl.
CPC ..... *F23D 14/08* (2013.01); *F24C 3/082* (2013.01); *F24C 3/085* (2013.01); *F23D 2203/007* (2013.01); *F23D 2205/00* (2013.01)

(58) Field of Classification Search
CPC ..... F23D 14/08
USPC ..... 126/39 R, 39 G, 39 N, 39 K
See application file for complete search history.

(56) References Cited

U.S. PATENT DOCUMENTS

| | | | | |
|---|---|---|---|---|
| 2,035,060 | A * | 3/1936 | Fox | F24C 3/12 126/42 |
| 2,083,602 | A | 6/1937 | Harper | |
| 2006/0201496 | A1 | 9/2006 | Shingler | |
| 2013/0068214 | A1 * | 3/2013 | Cadima | F24C 3/085 126/39 R |

* cited by examiner

*Primary Examiner* — Avinash A Savani
(74) *Attorney, Agent, or Firm* — Dority & Manning, P.A.

(57) ABSTRACT

A cooktop appliance includes a top panel that defines an opening. A first gas burner is positioned on the top panel at the opening of the top panel. A second gas burner includes a burner body, a horizontal mixing tube and a fuel orifice. The burner body is positioned on the top panel away from the opening of the top panel. The horizontal mixing tube is positioned below the top panel and extends between the burner body and the fuel orifice. The fuel orifice is positioned below the top panel at the opening of the top panel.

18 Claims, 6 Drawing Sheets

GAS BURNER FOR A COOKTOP APPLIANCE

FIELD OF THE INVENTION

The present subject matter relates generally to cooktop appliances with gas burners.

BACKGROUND OF THE INVENTION

Certain cooktop appliances include gas burners for heating pots, pans, griddles, etc. Various factors affect performance of the gas burners, including entrainment of air for fuel mixing prior to combustion. One mechanism to improve air entrainment is to use a long mixing throat, which also provides an increased residence time for mixing air and fuel. Long mixing throats can facilitate formation of a homogeneous mixture prior to combustion without significant pressure loss. However, gas burners with long mixing throats have certain drawbacks.

Long mixing throats are frequently horizontally oriented within the cooktop appliance due to space constraints. Cooktop appliances are frequently sold configured to burn natural gas and must be converted to burn propane. The conversion from natural gas to propane generally requires an installer to switch the gas orifices within the cooktop appliance to propane gas orifices. The horizontal mixing throat positions its fuel orifice far from its burner head. Thus, the installer is required to disassemble the cooktop to access and switch out the fuel orifice, and switching out the fuel orifices in cooktop appliances with horizontal mixing throats is tedious and time consuming.

BRIEF DESCRIPTION OF THE INVENTION

The present subject matter provides a cooktop appliance with a top panel that defines an opening. A first gas burner is positioned on the top panel at the opening of the top panel. A second gas burner includes a burner body, a horizontal mixing tube and a fuel orifice. The burner body is positioned on the top panel away from the opening of the top panel. The horizontal mixing tube is positioned below the top panel and extends between the burner body and the fuel orifice. The fuel orifice is positioned below the top panel at the opening of the top panel. Additional aspects and advantages of the invention will be set forth in part in the following description, or may be apparent from the description, or may be learned through practice of the invention.

In a first example embodiment, a cooktop appliance includes a top panel that defines an opening. A first gas burner is positioned on the top panel at the opening of the top panel. A second gas burner includes a burner body, a horizontal mixing tube and a fuel orifice. The burner body is positioned on the top panel away from the opening of the top panel. The horizontal mixing tube is positioned below the top panel and extends between the burner body and the fuel orifice. The fuel orifice is positioned below the top panel at the opening of the top panel.

In a second example embodiment, a cooktop appliance includes a top panel that defines an opening. A first gas burner includes a burner body, a vertical mixing tube and a fuel orifice. The burner body of the first gas burner is positioned on the top panel at the opening of the top panel. The fuel orifice of the first gas burner is positioned below the top panel. The vertical mixing tube extends through the opening of the top panel between the burner body of the first gas burner and the fuel orifice of the first gas burner. A second gas burner includes a burner body, a horizontal mixing tube and a fuel orifice. The burner body of the second gas burner is positioned on the top panel away from the opening of the top panel. The horizontal mixing tube is positioned below the top panel and extends between the burner body of the second gas burner and the fuel orifice of the second gas burner. The fuel orifice of the second gas burner is positioned below the opening of the top panel such that the fuel orifice of the second gas burner is accessible through the opening of the top panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
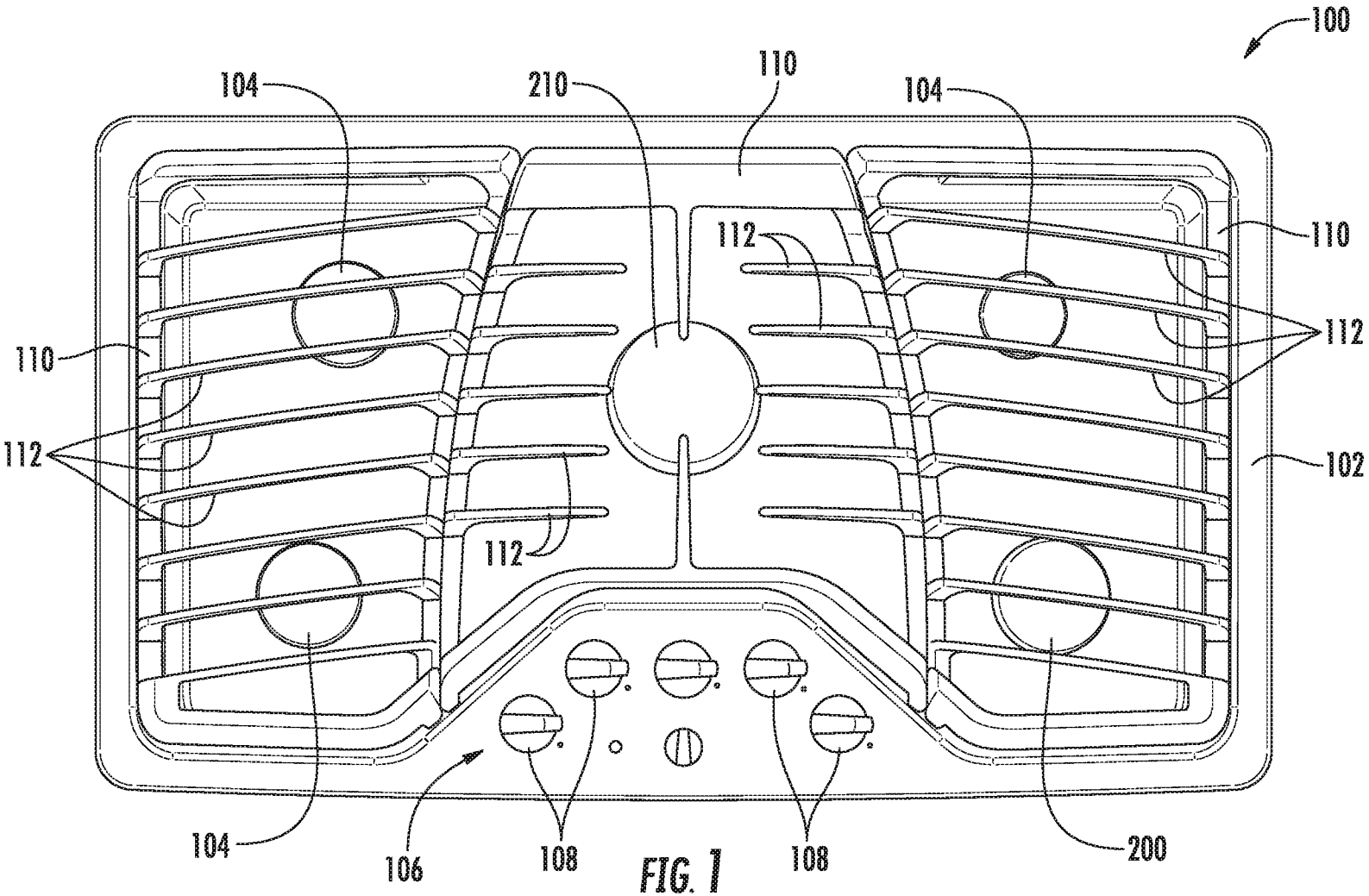
FIG. 1 provides a top, plan view of a cooktop appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner assembly described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an example embodiment of a cooktop appliance 100 of the present disclosure. Cooktop appliance 100 may be, e.g., fitted integrally with a surface of a kitchen counter or may be configured as a slide-in cooktop unit. Cooktop appliance 100 includes a top panel 102 that includes one or more heating sources, such as heating elements 104 for use in, e.g., heating or cooking. In general, top panel 102 may be constructed of any suitably rigid and heat resistant material capable of supporting heating elements 104, cooking utensils, grates 110, and/or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. For this example embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it will be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

Cooktop appliance 100 is generally referred to as "a gas cooktop," and heating elements 104 are gas burners, such as a gas burner assembly 120 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
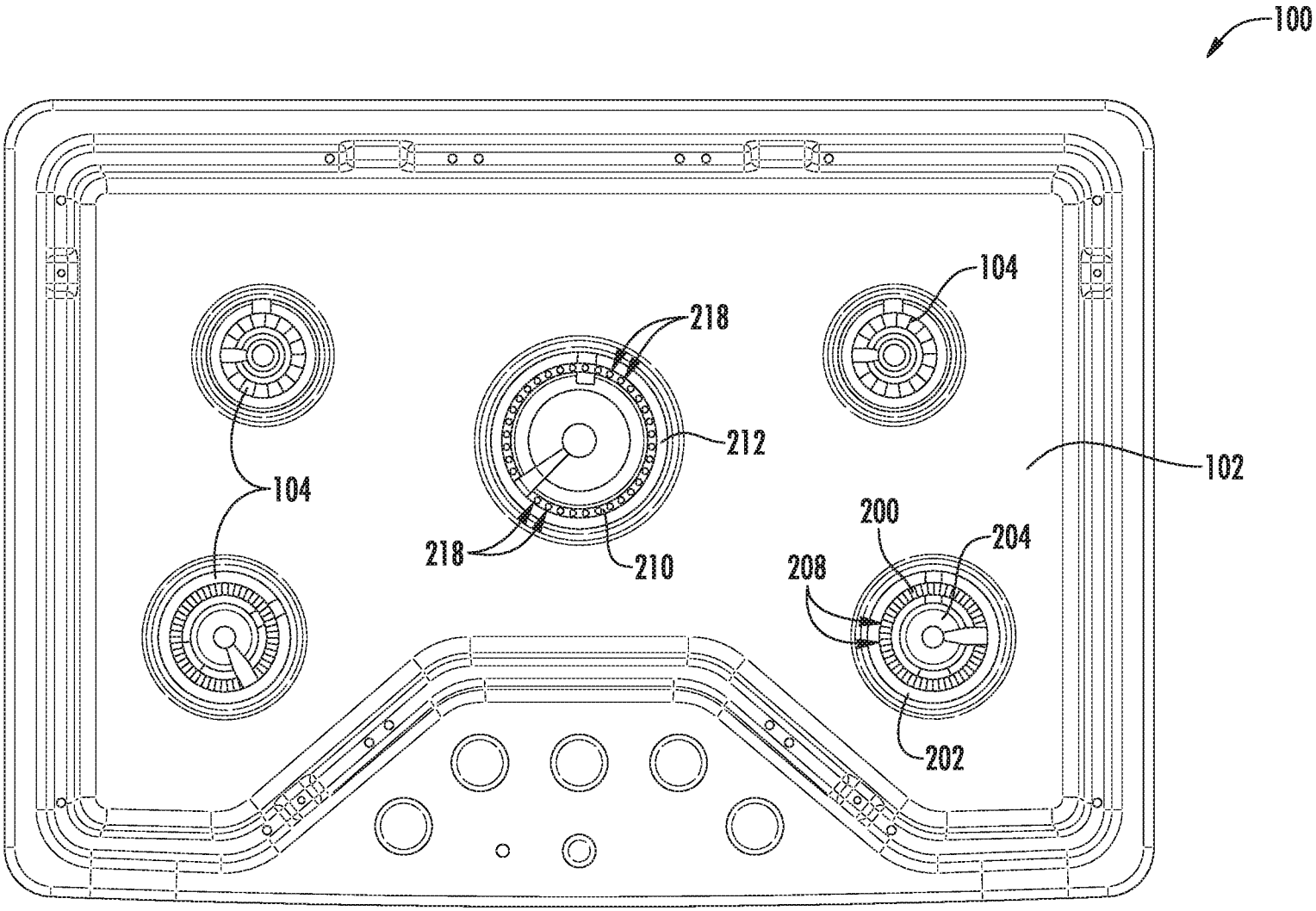
FIG. 2 is a top plan view of the example cooktop appliance of FIG. 1 with grates removed from a top panel of the example cooktop appliance.
Figure 3:
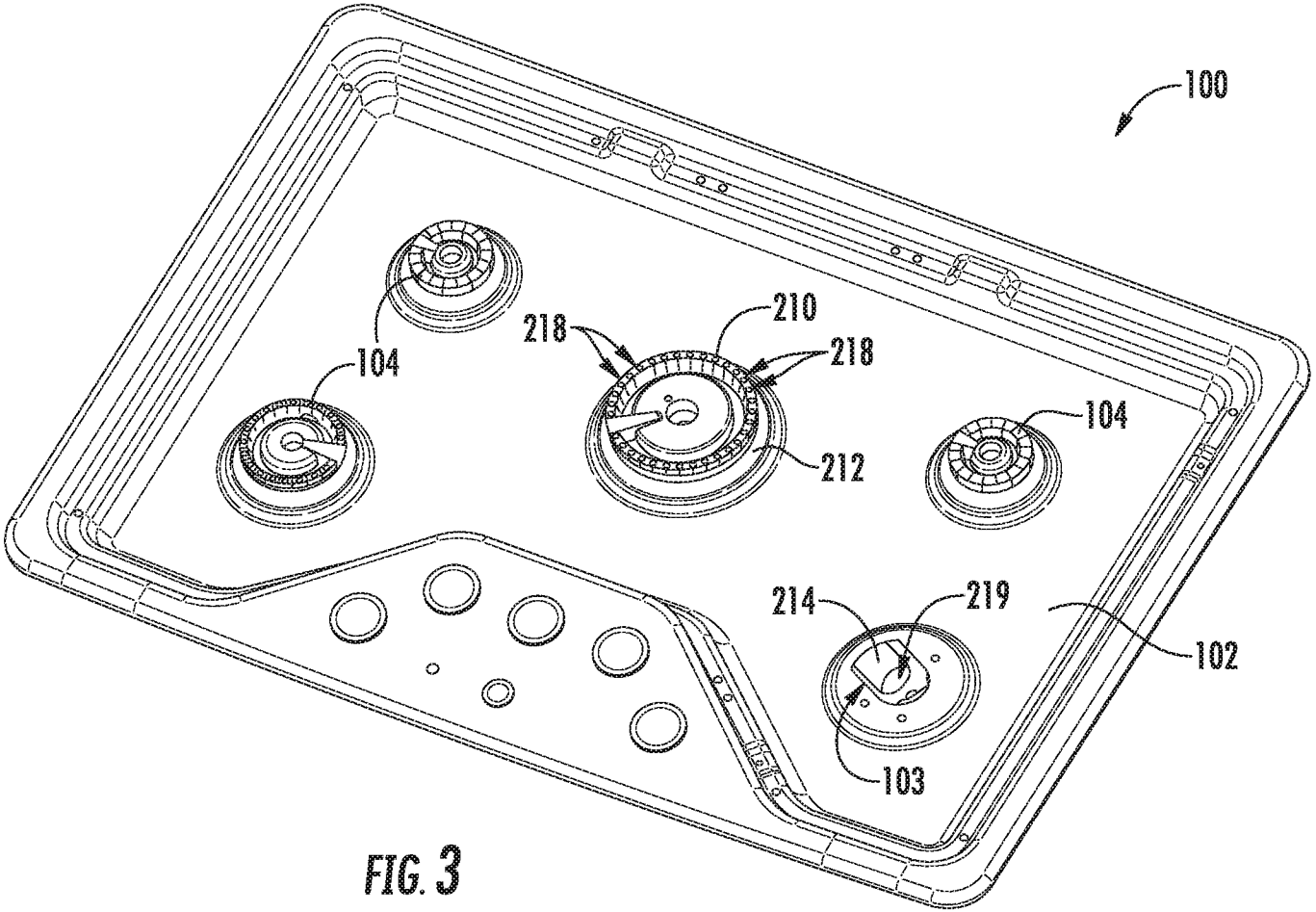
FIG. 3 is a top, perspective view of the example cooktop appliance of FIG. 2 where a first heating element is removed from the top panel of the example cooktop appliance.
Figure 4:
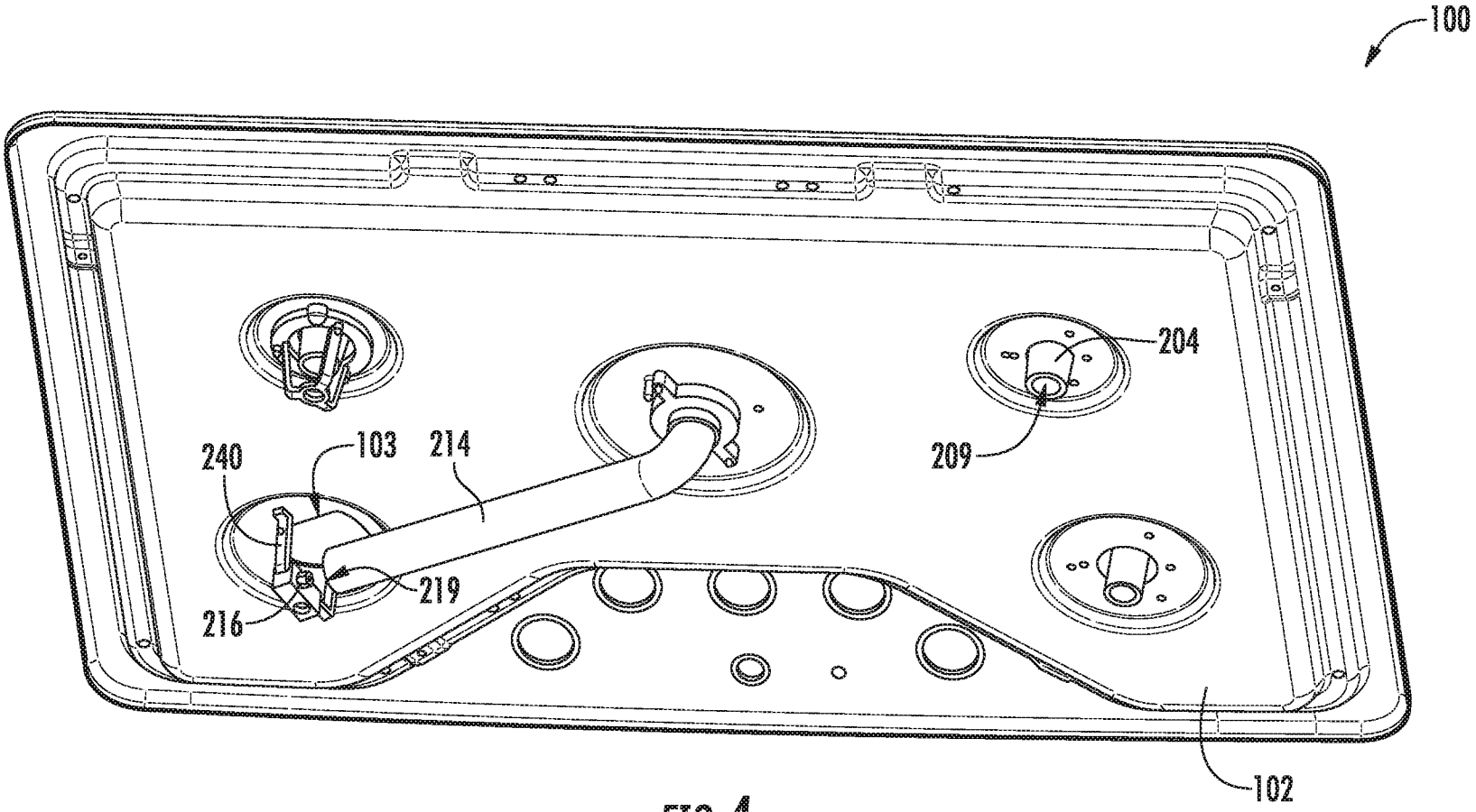
FIG. 4 is a bottom, perspective view of the example cooktop appliance of FIG. 3.
Figure 5:
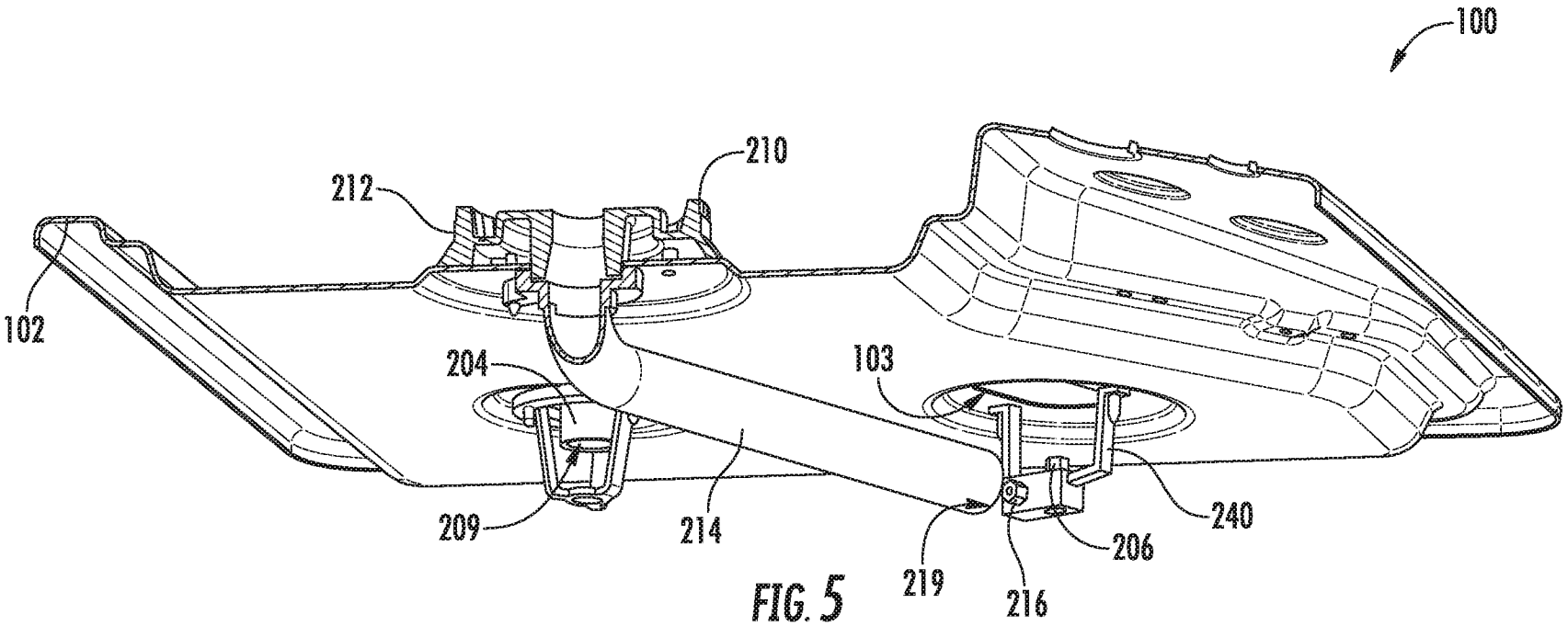
FIG. 5 is a section view of the example cooktop appliance of FIG. 3.

FIG. 2 is a top plan view of cooktop appliance 100. In FIG. 2, grates 110 are removed from top panel 102. As shown in FIG. 2, heating elements 104 includes a first gas burner 200 and a second gas burner 210. FIG. 3 is a top, perspective view of cooktop appliance 100. In FIG. 3, first gas burner 200 is removed from top panel 102. An opening 103 in top panel 102 is revealed when first heating element 200 is removed from top panel 102. FIG. 4 is a bottom, perspective view of cooktop appliance 100, and FIG. 5 is a section view of cooktop appliance 100. Features of cooktop appliance 100 that assist with switching cooktop appliance between fuel sources are discussed in greater detail below in the context of FIGS. 2 through 5.

First gas burner 200 includes a burner body 202, a vertical mixing tube 204 and a fuel orifice 206. A vertical mixing tube of another of one of heating elements 104 is labeled in FIGS. 4 and 5, but it will be understood that vertical mixing tube 204 of first gas burner 200 is constructed and arranged in a similar manner at opening 103 when burner body 202 of first gas burner 200 is positioned on top panel 102 over opening 103. Burner body 202 of first gas burner 200 defines a plurality of flame ports 208. During operation of first gas burner 200, a mixture of gaseous fuel and air may flow out of burner body 202 of first gas burner 200 through flame ports 208, and the mixture of gaseous fuel and air may be combusted outside of flame ports 208.

Burner body 202 of first gas burner 200 is positioned on top panel 102 at opening 103 of top panel 102. Thus, e.g., burner body 202 of first gas burner 200 may rest on top panel 102 such that burner body 202 of first gas burner 200 covers opening 103. Fuel orifice 206 of first gas burner 200 is positioned below top panel 102. In particular, fuel orifice 206 of first gas burner 200 may be positioned directly below opening 103 of top panel 102. Thus, fuel orifice 206 of first gas burner 200 may be accessible through opening 103 of top panel 102, and an installer may reach through opening 103 (e.g., with a wrench or other suitable tool) to change out fuel orifice 206 of first gas burner 200.

Vertical mixing tube 204 extends downwardly from burner body 202 of first gas burner 200. Vertical mixing tube 204 may extend through opening 103 of top panel 102 between burner body 202 of first gas burner 200 and fuel orifice 206 of first gas burner 200. An inlet 209 of vertical mixing tube 204 may be spaced from and positioned directly over fuel orifice 206 of first gas burner 200. Thus, a flow of gaseous fuel from fuel orifice 206 of first gas burner 200 may flow upwardly into vertical mixing tube 204 at inlet 209 of vertical mixing tube 204. Between fuel orifice 206 of first gas burner 200 and inlet 209 of vertical mixing tube 204, the flow of gaseous fuel may entrain air to facilitate combustion at flame ports 208. Vertical mixing tube 204 may be a vertical Venturi mixing tube with a suitable inner surface geometry to form an injector with the Venturi effect of a converging-diverging nozzle.

Second gas burner 210 includes a burner body 212, a horizontal mixing tube 214 and a fuel orifice 216. Burner body 212 of second gas burner 210 defines a plurality of flame ports 218. During operation of second gas burner 210, a mixture of gaseous fuel and air may flow out of burner body 212 of second gas burner 210 through flame ports 218, and the mixture of gaseous fuel and air may be combusted outside of flame ports 218. Second gas burner 210 may be operated independently of first gas burner 200. Thus, e.g., fuel flow through fuel orifice 206 of first gas burner 200 and fuel flow through fuel orifice 216 of second gas burner 210 may each be regulated with a respective one of control knobs 108.

Burner body 212 of second gas burner 210 is positioned on top panel 102 away from opening 103 of top panel 102. Thus, e.g., burner body 212 of second gas burner 210 may rest on top panel 102 such that burner body 212 of second gas burner 210 is spaced apart from opening 103. For example, burner body 212 of second gas burner 210 may be positioned on top panel 102 such that burner body 212 of second gas burner 210 is spaced from opening 103 of top panel 102 (e.g., and burner body 202 of first gas burner 200) by no less than five inches (5") and no more than twenty inches (20").

Fuel orifice 216 of second gas burner 210 is positioned below top panel 102. In particular, fuel orifice 216 of second gas burner 210 may be positioned directly below opening 103 of top panel 102. Thus, fuel orifice 216 of second gas burner 210 may be accessible through opening 103 of top panel 102, and an installer may reach through opening 103 (e.g., with a wrench or other suitable tool) to change out fuel orifice 216 of second gas burner 210.

Horizontal mixing tube 214 is positioned below top panel 102. Horizontal mixing tube 214 extends in a generally horizontal manner between burner body 212 of second gas burner 210 and fuel orifice 216 of second gas burner 210. An inlet 219 of horizontal mixing tube 214 is positioned adjacent fuel orifice 216 of second gas burner 210. In particular, an inlet 219 of horizontal mixing tube 214 may be spaced from and aligned (e.g., concentrically) with fuel orifice 216 of second gas burner 210. Thus, a flow of gaseous fuel from fuel orifice 216 of second gas burner 210 may flow horizontally into horizontal mixing tube 214 at inlet 219 of horizontal mixing tube 214. Between fuel orifice 216 of second gas burner 210 and inlet 219 of horizontal mixing tube 214, the flow of gaseous fuel may entrain air to facilitate combustion at flame ports 218. Horizontal mixing tube 214 may be a horizontal Venturi mixing tube with a suitable inner surface geometry to form an injector with the Venturi effect of a converging-diverging nozzle.

Second gas burner 210 may be configured such that second gas burner 210 has a greater maximum heat output than first gas burner 200. For example, the longer horizontal mixing tube 214 provides greater entrainment of air relative to the shorter vertical mixing tube 204. The longer horizontal mixing tube 214 may also provide additional time mixing for gaseous fuel and air relative to the shorter vertical mixing tube 204 without adding significant pressure losses. It will be understood that cooktop appliance 100 may also include a pump 230 (shown schematically in FIG. 6) upstream of fuel orifice 216 of second gas burner 210 that is operable to increase the pressure of gaseous fuel supplied to fuel orifice 216 of second gas burner 210. The increased pressure provided by the pump 230 may increase a velocity of the flow of gaseous fuel into horizontal mixing tube 214 and thereby increase the entrainment of air into horizontal mixing tube 214. Thus, the fuel supply of second gas burner 210 may be coupled to pump 230 to assist with increasing the maximum heat output of second gas burner 210 relative to first gas burner 200.

Figure 6:
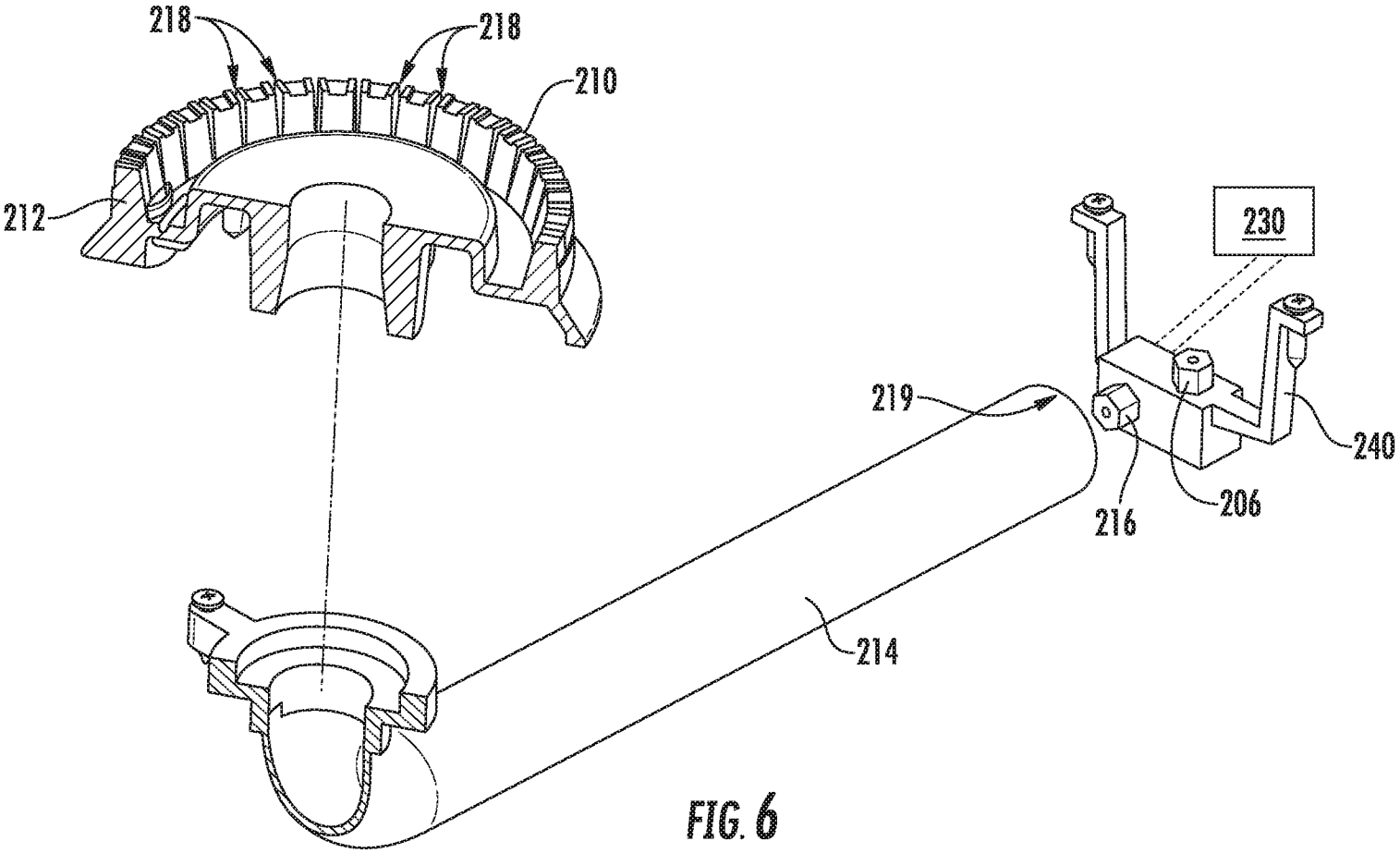
FIG. 6 is an exploded partial, section view of a second heating element of the example cooktop appliance of FIG. 3.

FIG. 6 is an exploded partial, section view of second heating element 210. As may be seen in FIGS. 5 and 6, cooktop appliance 100 includes an injet bracket 240. Injet bracket 240 may be mounted to top panel 102 below first gas burner 200. Fuel orifices 206, 216 may both be mounted on injet bracket 240. For example, fuel orifices 206, 216 may be threaded to injet bracket 240.

As may be seen from the above, cooktop appliance 100 includes features for accessing fuel orifice 216 of second gas burner 210 through top panel 102. In particular, fuel orifice 216 of second gas burner 210 may be accessible through a common opening 103 with fuel orifice 206 of first gas burner 200. Thus, an installer can simply remove burner body 202 of first gas burner 200 from top panel 102 to reveal opening 103 of top panel 102, and the installer may reach through opening 103 to access and manipulate fuel orifices 206, 216. The installer switching fuel orifices 206, 216 need not remove cooktop appliance 100 from an associated cabinet or significantly disassemble cooktop appliance 100 to switch fuel orifices 206, 216, e.g., between natural gas fuel orifices and propane fuel orifices. Thus, fuel orifices 206, 216 may be switch out more easily in cooktop appliance 100 compared to known cooktops.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel that defines an opening;

a first gas burner positioned on the top panel at the opening of the top panel, a fuel orifice of the first gas burner positioned below the top panel at the opening of the top panel; and a second gas burner comprising a burner body, a horizontal mixing tube and a fuel orifice, the burner body positioned on the top panel away from the opening of the top panel, the horizontal mixing tube positioned below the top panel and extending between the burner body and the fuel orifice of the second gas burner, the fuel orifice of the second gas burner positioned below the top panel at the opening of the top panel, wherein the fuel orifice of the first gas burner and the fuel orifice of the second gas burner are positioned directly below the opening of the top panel.

2. The cooktop appliance of claim 1, wherein the fuel orifice of the second gas burner is positioned below the opening of the top panel such that the fuel orifice of the second gas burner is accessible through the opening of the top panel.

3. The cooktop appliance of claim 2, wherein the fuel orifice of the second gas burner is accessible through the opening of the top panel such that the fuel orifice of the second gas burner is changeable between a natural gas fuel orifice and a propane fuel orifice through the opening of the top panel.

4. The cooktop appliance of claim 1, further comprising an injet bracket mounted to the top panel below the first gas burner, a fuel orifice of the first gas burner mounted on the injet bracket, the fuel orifice of the second gas burner also mounted on the injet bracket.

5. The cooktop appliance of claim 4, wherein the fuel orifice of the first gas burner and the fuel orifice of the second gas burner are threaded to the inlet bracket.

6. The cooktop appliance of claim 1, wherein the burner body is positioned on the top panel such that the burner body is spaced from the opening of the top panel by no less than five inches and no more than twenty inches.

7. The cooktop appliance of claim 1, wherein an inlet of the horizontal mixing tube is positioned adjacent the fuel orifice of the second gas burner.

8. The cooktop appliance of claim 1, wherein the horizontal mixing tube is a horizontal Venturi mixing tube.

9. The cooktop appliance of claim 1, wherein the first gas burner comprises a burner body and a vertical mixing tube, the burner body of the first gas burner positioned on the top panel, the fuel orifice of the first gas burner positioned below the top panel, the vertical mixing tube extending through the opening of the top panel between the burner body of the first gas burner and the fuel orifice of the first gas burner.

10. The cooktop appliance of claim 9, wherein the second gas burner is configured such that the second gas burner has a greater maximum heat output than the first gas burner.

11. A cooktop appliance, comprising:

a top panel that defines an opening;

a first gas burner comprising a burner body, a vertical mixing tube and a fuel orifice, the burner body of the first gas burner positioned on the top panel at the opening of the top panel, the fuel orifice of the first gas burner positioned below the top panel, the vertical mixing tube extending through the opening of the top panel between the burner body of the first gas burner and the fuel orifice of the first gas burner;

a second gas burner comprising a burner body, a horizontal mixing tube and a fuel orifice, the burner body of the second gas burner positioned on the top panel away from the opening of the top panel, the horizontal mixing tube positioned below the top panel and extending between the burner body of the second gas burner and the fuel orifice of the second gas burner, the fuel orifice of the second gas burner positioned below the opening of the top panel such that the fuel orifice of the second gas burner is accessible through the opening of the top panel, wherein the fuel orifice of the first gas burner and the fuel orifice of the second gas burner are positioned directly below the opening of the top panel.

12. The cooktop appliance of claim 11, wherein the fuel orifice of the second gas burner is accessible through the opening of the top panel such that the fuel orifice of the second gas burner is changeable between a natural gas fuel orifice and a propane fuel orifice through the opening of the top panel.

13. The cooktop appliance of claim 11, further comprising an injet bracket mounted to the top panel below the first gas burner, the fuel orifices of the first and second gas burners both mounted on the injet bracket.

14. The cooktop appliance of claim 13, wherein the fuel orifice of the first gas burner and the fuel orifice of the second gas burner are threaded to the injet bracket.

15. The cooktop appliance of claim 11, wherein the burner body of the second gas burner is positioned on the top panel such that the burner body of the second gas burner is spaced from the opening of the top panel by no less than five inches and no more than twenty inches.

16. The cooktop appliance of claim 11, wherein an inlet of the horizontal mixing tube is positioned adjacent the fuel orifice of the second gas burner.

17. The cooktop appliance of claim 11, wherein the horizontal mixing tube is a horizontal Venturi mixing tube.

18. The cooktop appliance of claim 11, wherein the second gas burner is configured such that the second gas burner has a greater maximum heat output than the first gas burner.

* * * * *